US011148428B2

(12) United States Patent
Jeran

(10) Patent No.: US 11,148,428 B2
(45) Date of Patent: Oct. 19, 2021

(54) PRINTING MATERIAL CARTRIDGE

(71) Applicant: HEWLETT-PACKARD DEVELOPMENT COMPANY, L.P., Spring, TX (US)

(72) Inventor: Paul Jeran, Boise, ID (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/710,652

(22) Filed: Dec. 11, 2019

(65) Prior Publication Data

US 2020/0114653 A1 Apr. 16, 2020

Related U.S. Application Data

(63) Continuation of application No. 15/819,690, filed on Nov. 21, 2017, now abandoned, which is a continuation of application No. 15/458,460, filed on Mar. 14, 2017, now abandoned, which is a continuation of application No. PCT/US2015/027271, filed on Apr. 23, 2015.

(51) Int. Cl.
*B41J 2/175* (2006.01)

(52) U.S. Cl.
CPC ..... *B41J 2/17543* (2013.01); *B41J 2/17546* (2013.01)

(58) Field of Classification Search
CPC ..... B41J 2/17546; B41J 2/17543
See application file for complete search history.

(56) References Cited

U.S. PATENT DOCUMENTS

| | | | | |
|---|---|---|---|---|
| 5,807,005 | A | 9/1998 | Wright | |
| 7,182,445 | B2 | 2/2007 | Johnson et al. | |
| 7,257,335 | B1 | 8/2007 | Chan | |
| 8,891,982 | B2 | 11/2014 | Thacker et al. | |
| 2004/0136768 | A1 | 7/2004 | Gary | |
| 2004/0212651 | A1* | 10/2004 | Johnson | B41J 29/393 347/19 |

(Continued)

FOREIGN PATENT DOCUMENTS

| | | |
|---|---|---|
| CN | 101088050 | 12/2007 |
| CN | 101365591 | 2/2009 |

(Continued)

OTHER PUBLICATIONS

"We Refill printer Cartidges!", University of Arizona Bookstores, 2015, 2 pages.

(Continued)

*Primary Examiner* — Bradley W Thies
(74) *Attorney, Agent, or Firm* — Staas & Halsey LLP

(57) ABSTRACT

In one example, a printing material cartridge includes a container to contain a printing material and a memory to enable an exchange of information between the cartridge and a printer controller when the cartridge is installed in the printer. The memory includes a first write once then read only memory with a first memory address, a second write once then read only memory with a second memory address, the first memory address having information to prompt the printer controller to write a printer identifier to the second memory address, and a memory controller to control data storage and retrieval to and from the write once then read only memories and to control the exchange of information with the printer controller.

17 Claims, 10 Drawing Sheets

(56) References Cited

U.S. PATENT DOCUMENTS

| | | | | |
|---|---|---|---|---|
| 2006/0007258 | A1 | 1/2006 | Jacobsen et al. | |
| 2006/0034624 | A1 | 2/2006 | Burchette et al. | |
| 2007/0081842 | A1 | 4/2007 | Ehrhardt, Jr. | |
| 2007/0154228 | A1 | 7/2007 | Chan | |
| 2008/0219692 | A1* | 9/2008 | Kondo | G03G 21/1882 399/83 |
| 2009/0052946 | A1 | 2/2009 | Inukai et al. | |
| 2009/0060546 | A1 | 3/2009 | Tanaka et al. | |
| 2010/0253718 | A1* | 10/2010 | Asauchi | B41J 2/17566 347/7 |
| 2012/0317662 | A1* | 12/2012 | Neo | G06F 21/44 726/34 |
| 2013/0108281 | A1 | 5/2013 | Chang | |
| 2014/0177007 | A1* | 6/2014 | Ganesan | G06F 21/84 358/3.28 |

FOREIGN PATENT DOCUMENTS

| | | | |
|---|---|---|---|
| CN | 101468550 | | 7/2009 |
| CN | 102285241 | | 12/2011 |
| CN | 202138071 | | 2/2012 |
| CN | 103302988 | | 9/2013 |
| EP | 0878305 | | 11/1998 |
| EP | 2075134 | | 7/2009 |
| EP | 2390098 | | 11/2011 |
| JP | 1996174863 | | 7/1996 |
| JP | 2002307710 | | 10/2002 |
| JP | 2005070315 | | 3/2005 |
| JP | 2006318486 | | 11/2006 |
| JP | 2008074100 | | 4/2008 |
| JP | 2008149724 | | 7/2008 |
| JP | 2010012659 | | 1/2010 |
| JP | 2012051269 | | 3/2012 |
| TW | 200500212 | | 1/2005 |
| TW | 200600356 | A | 1/2006 |
| WO | WO-2014035408 | A1 | 3/2014 |

OTHER PUBLICATIONS

Kipman, Yair, et al., "Scanner-based Image Quality Measurement System for Automated Analysis of Ep Output", SPIE Proceedings, vol. 5294, Measurement and Modeling II, 2 pgs.

* cited by examiner

PRINTING MATERIAL CARTRIDGE

CROSS REFERENCE TO RELATED APPLICATIONS

This is a continuation of U.S. patent application Ser. No. 15/819,690 filed Nov. 21, 2017 which is a continuation of U.S. patent application Ser. No. 15/458,460 filed Mar. 14, 2017 which is a continuation of international patent application no. PCT/US2015/027271 filed Apr. 23, 2015, each of which is incorporated herein by reference in its entirety.

BACKGROUND

In many printers, toner, ink and other printing materials are contained in removable cartridges that may be replaced periodically, for example when the printing material is fully consumed. Printing material cartridges may include a memory that enables the exchange of information between a cartridge and the printer controller when the cartridge is installed in the printer.

DRAWINGS

The same part numbers designate the same or similar parts throughout the figures.

DESCRIPTION

It may be desirable in some printing applications to control the printing material cartridges that can be used in a printer or group of printers. For example, the parties to a print services contract may wish to limit printing to specific cartridges supplied under the contract. A new technique has been developed utilizing the memory on a printing material cartridge to help ensure that a printer will not print with an unauthorized cartridge. In one example, the cartridge memory is programmed with a first memory address storing a value that when read by a printer prompts the printer to write a printer identifier to a second (different) memory address.

Both the first and second memory addresses are write once then read only memories so that, once written, both the prompt (at the first memory address) and the printer ID (at the second memory address) may not be altered. Thus, when the cartridge is first installed into a printer and a printer ID written to the cartridge memory, the cartridge will thereafter only work in that printer or in another printer with a matching ID. The printer ID may identify a single printer or a group of printers. For example, in the case of a print services contract, the printer ID may be a fleet ID that identifies a fleet of contract printers that can use the cartridge.

This and other examples described herein illustrate but do not limit the scope of the patent, which is defined in the Claims following this Description.

As used in this document, a "fleet" of printers means a group of printers owned or operated by a single entity or identified as being subject to an obligation to limit printing to the group; and a "memory" means any non-transitory tangible processor readable medium that can embody, contain, store, or maintain information or instructions for use by a processor.

Figure 1:
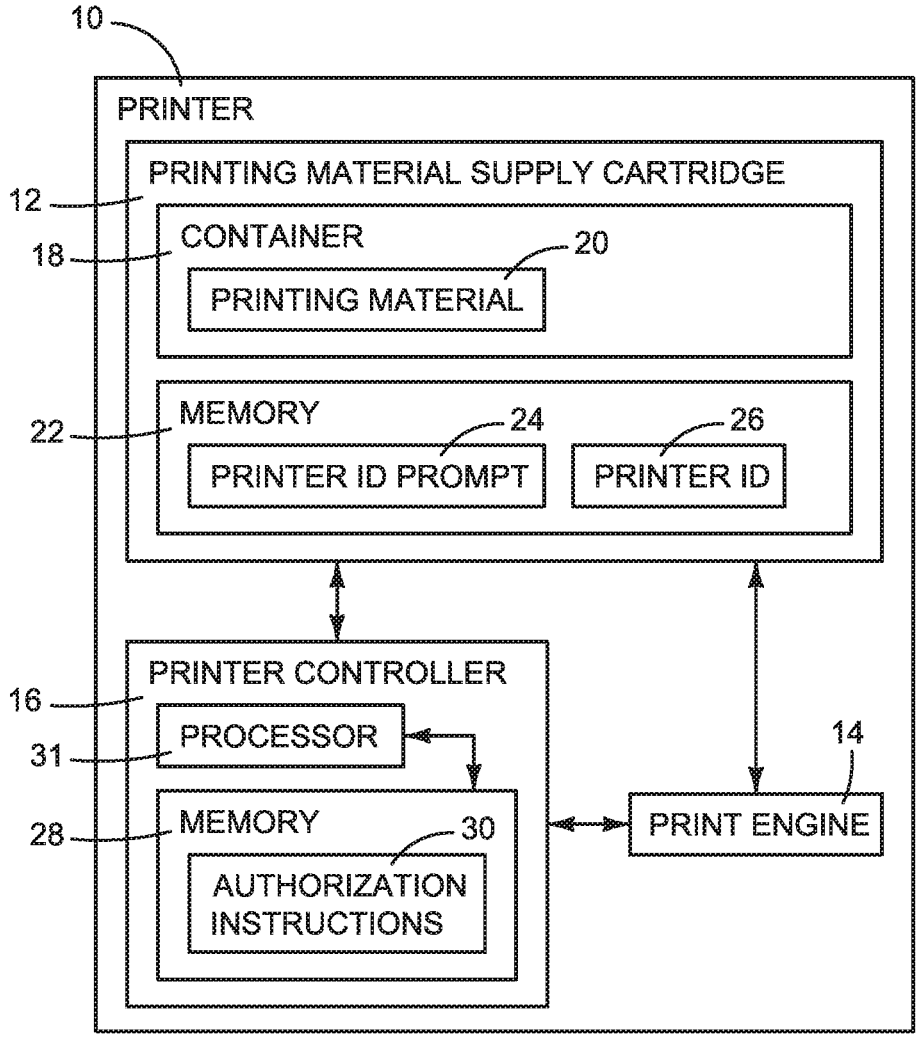
FIG. 1 illustrates a printer implementing one example of a printing material cartridge.

FIG. 1 is a block diagram illustrating a printer 10 implementing one example of a new printing material cartridge 12. Referring to FIG. 1, printer 10 includes cartridge 12, a print engine 14 and a controller 16 operatively connected to cartridge 12 and print engine 14. Printing material cartridge 12 is a replaceable component that supplies toner, ink or another printing material to print engine 14. While only one cartridge 12 is shown, printer 10 may include multiple printing material cartridges 12. For example, color printers may include an individual cartridge 12 for each color printing material.

Print engine 14 represents the printer components that apply a print material from cartridge 12 to a paper or other print substrate in the desired pattern for a printed image. In a laser printer 10, for example, print engine 14 may include an imaging laser, a photoconductor, a fuser and a transport system to move the print substrate past the photoconductor and the fuser. In an inkjet printer, for another example, print engine 14 may include a printhead and a transport system to move the print substrate past the printhead. Some components of print engine 14 may be part of cartridge 12. For example, in a laser printer 10, the photoconductor may be part of a toner cartridge 12. For another example, in an inkjet printer 10, the printhead may be part of an ink cartridge 12.

Cartridge 12 includes a container 18 containing printing material 20 and a memory 22 with an address 24 for a printer identification prompt and an address 26 for a printer identification. A cartridge memory 22 is usually embodied in an integrated circuit "chip" affixed to container 18 and operatively connected to printer controller 16 through a series of contact pads and conductive traces. Printer controller 16 represents the programming, processing and associated memory, and the other electronic circuitry and components needed to control cartridge 12 and the operative elements of printer 10. In particular, controller 16 includes a memory 28 with cartridge authorization instructions 30 and a processor 31 to execute instructions 30. As described in detail below, authorization instructions 30 include instructions to communicate with cartridge memory 22 to read from and/or write to memory addresses 24 and 26, for example while initializing a new cartridge 12 installed in printer 10.

Figure 2:
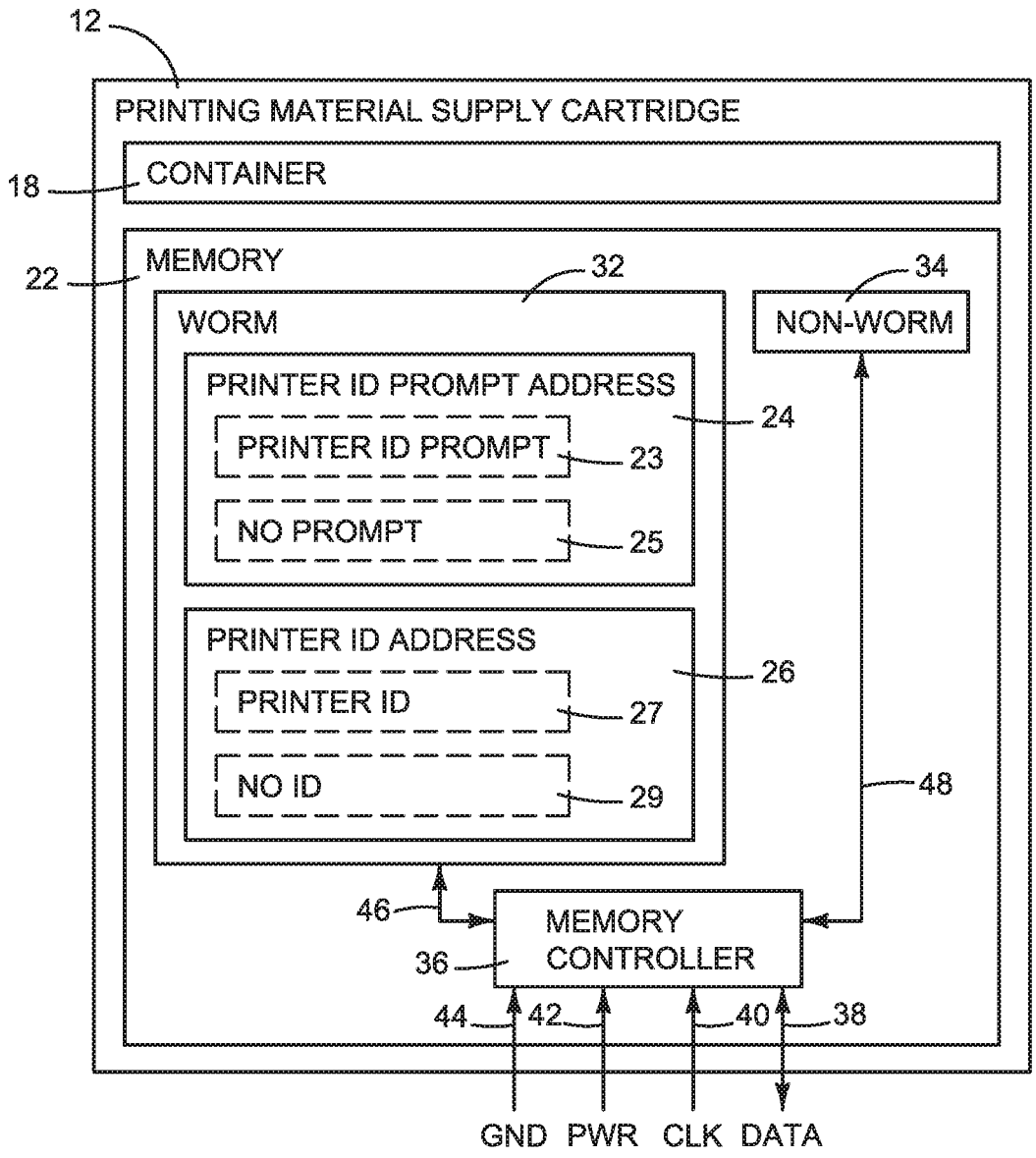
FIG. 2 illustrates one example of a printing material cartridge such as might be used in the printer shown in FIG. 1.

Referring now to FIG. 2 illustrating one example of a printing material cartridge 12 in more detail, cartridge memory 22 includes a write once then read only memory 32 and a rewriteable memory 34. A write once then read only memory is commonly referred to with the acronym WORM (write once read many). Thus, write once then read only memory 32 and rewriteable memory 34 are denoted by WORM and non-WORM in FIG. 2. Although not shown in FIG. 2, in addition to a prompt at address 24 and a printer ID at address 26, WORM and non-WORM memories 32, 34 may include, for example, factory set configuration information that assists printer controller 16 with printing operations and usage information collected and stored after the cartridge is installed in a printer.

Prompt address 24 may have a prompt value or state 23 or a no prompt value or state 25. In one example, prompt address 24 is implemented as a single bit memory location that is either in an unwritten state (a logic 0) for no prompt 25 or a written state (a logic 1) for a prompt 23. Printer ID address 26 may have an ID value or state 27 or a no ID value or state 29. In one example, printer ID address 26 is implemented as a 16 bit memory location that is either in an unwritten state (0x0000) for no ID or a written state with a value representing an ID for an individual printer or a group of printers. Any suitable parameter may be used to identify a printer or group of printers including, for example, serial numbers, MAC (media access control) addresses, and customer or contract numbers for fleet IDs. The printer ID value 29 written to cartridge memory address 26 may be a hashed, encrypted or other derived version of the actual ID parameter.

Cartridge memory 22 also includes a controller 36 to control data storage and retrieval to and from memories 32, 34. Controller 36 exchanges information with printer controller 16 through data and clock terminals 38, 40 and with memories 32, 34 through internal busses 46, 48. Power is supplied to cartridge memory 22 through power and ground terminals 42, 44. Printer controller 16 initiates a read operation by sending address and control signals to data terminal 38 and the appropriate clock signals to clock terminal 40. In response, cartridge memory controller 36 retrieves the data from the memory address identified in the read command and returns the data to data terminal 38. Similarly, printer controller 16 initiates a write operation by sending data, address, and control signals to data terminal 38 and the appropriate clock signals to clock terminal 40. In response, cartridge memory controller 36 stores the data at the memory address identified in the write command. Although a four terminal memory 22 is shown in FIG. 2, other configurations are possible. For example, it may be desirable in some implementations to use a two terminal memory in which data and clock signals are transferred through the power terminal.

While container 18 in cartridge 12 will usually contain printing material 20 when installed in a printer 10 as shown in FIG. 1, cartridge 12 in FIG. 2 represents a printing material cartridge with or without printing material 20 including, for example, an empty cartridge before it is filled (or refilled) with printing material. Also, the configuration of a cartridge memory 22 in FIG. 2 is just one example. Other suitable configurations for cartridge memory 22 are possible, including other or different components, addresses, and/or information not shown in FIG. 2.

Figure 3:
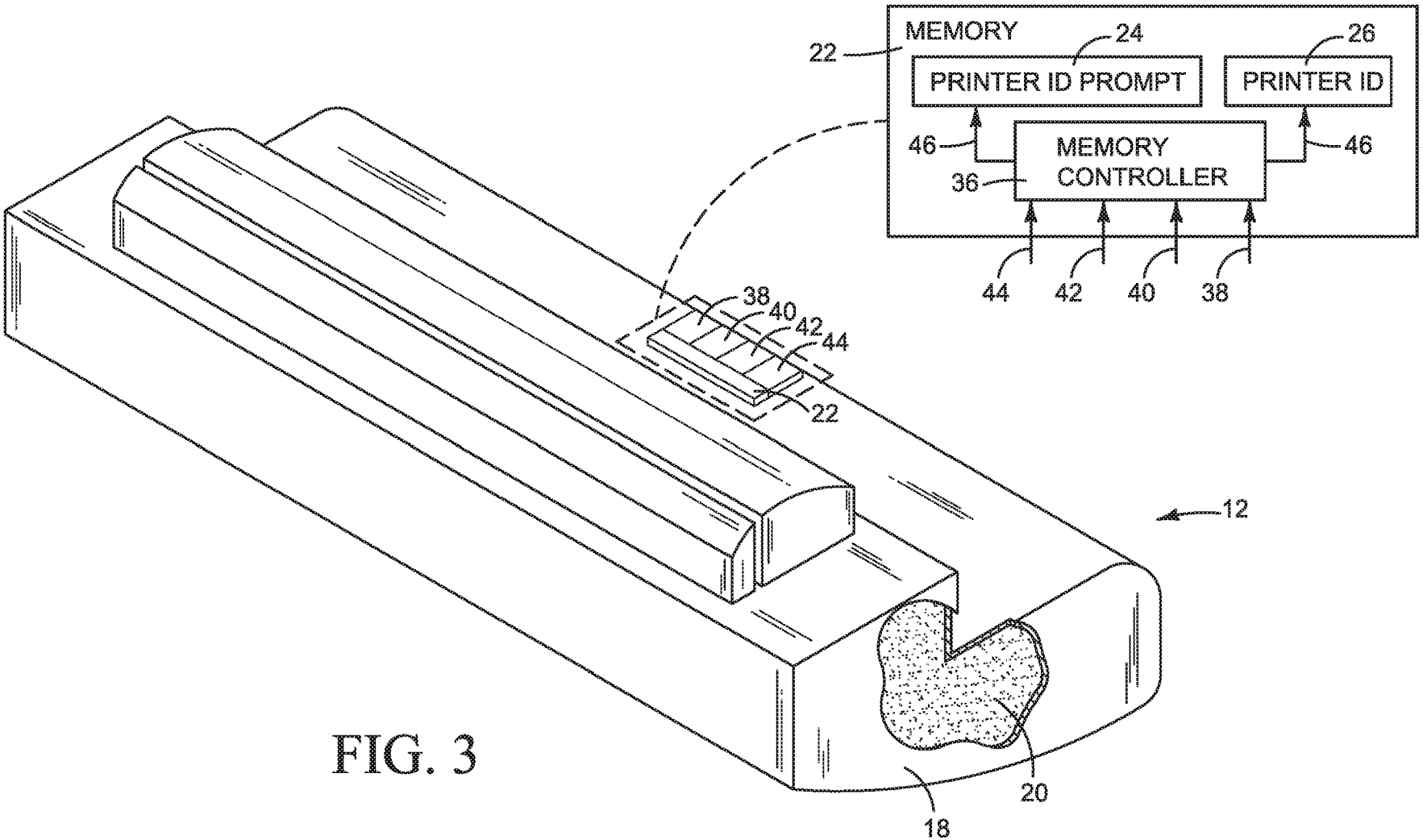
FIG. 3 illustrates one example of a toner cartridge.
Figure 4:
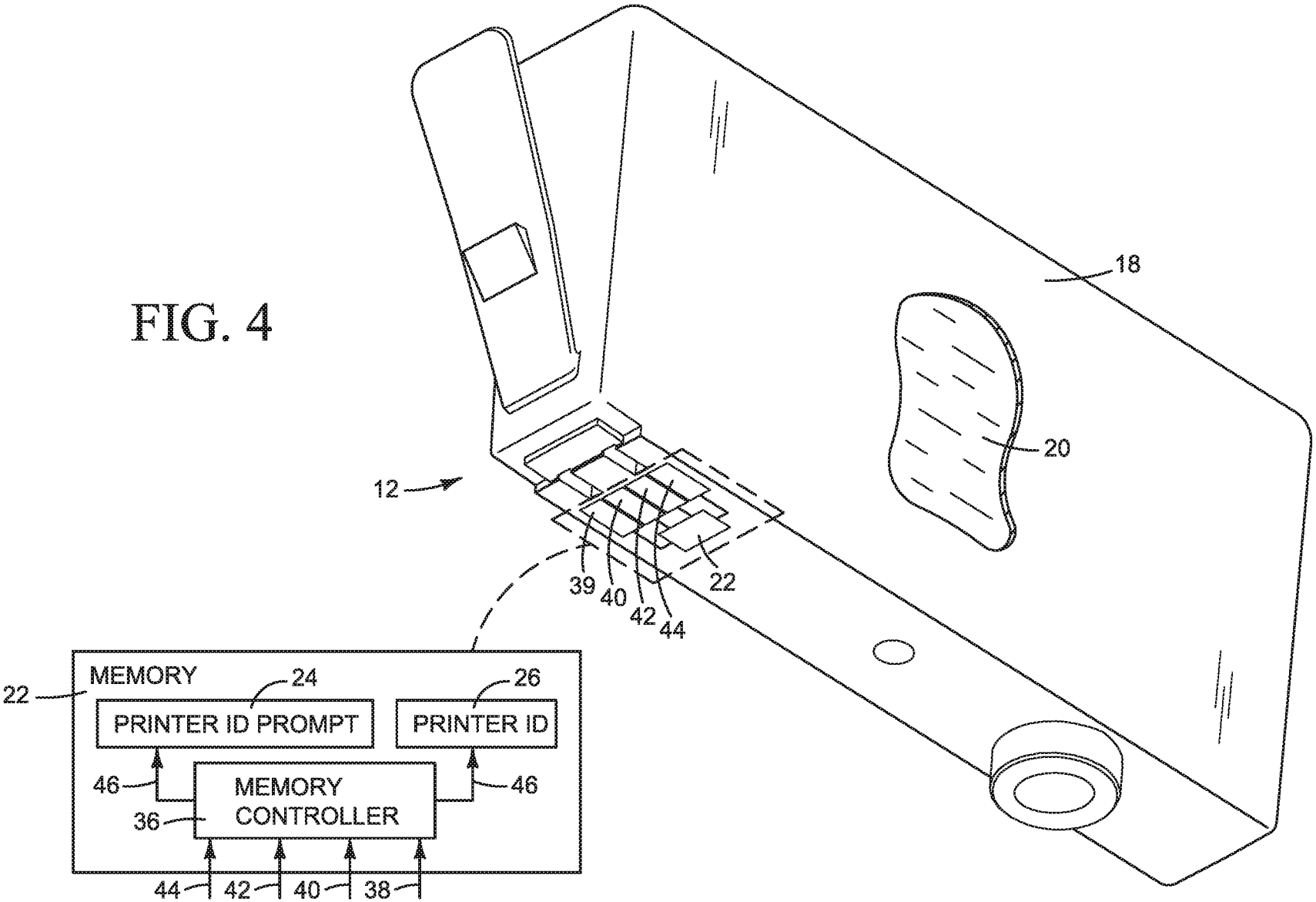
FIG. 4 illustrates one example of an ink cartridge.

In one example, printing material cartridge 12 is implemented as a toner cartridge 12 shown in FIG. 3. In another example, printing material cartridge 12 is implemented as an ink cartridge 12 shown in FIG. 4.

Figure 5:
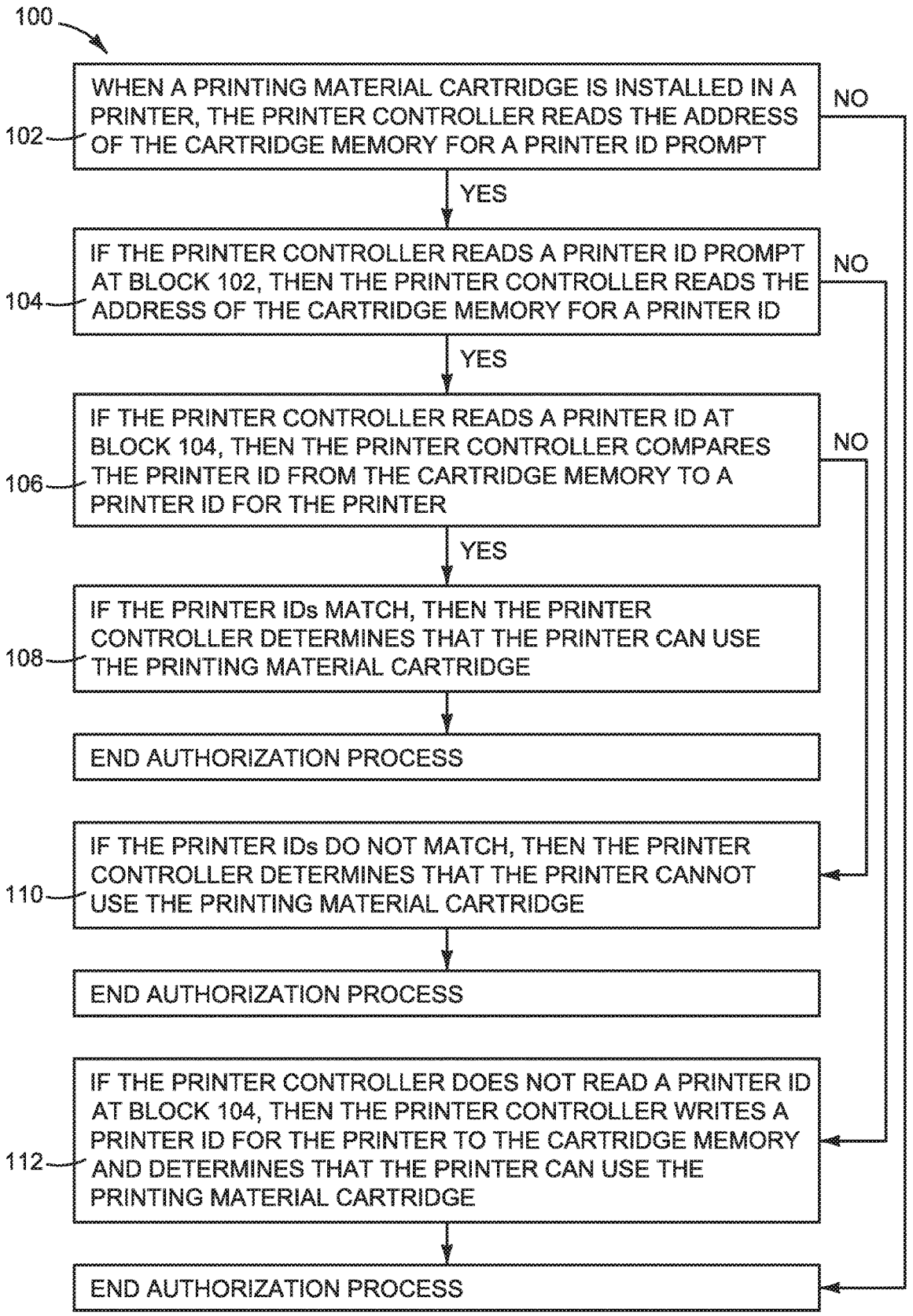
FIG. 5 illustrates one example of an authorization process for a printing material cartridge, such as might be implemented in the printer shown in FIG. 1.

FIG. 5 is a flow diagram illustrating one example of an authorization process 100 for a printing material cartridge such as a cartridge 12 shown in FIGS. 1-4. The parts numbers from FIGS. 1-4 are used in the following description of authorization process 100. Authorization process 100 may be implemented, for example, by processor 31 executing authorization instructions 30 on a printer controller 16. An authorization process 100 does not exclude other authorization and/or authentication processes executing on controller 16, and process 100 in FIG. 5 may itself be part of an authentication process that includes other elements, routines and/or sub-routines.

Referring to FIG. 5, when a printing material cartridge 12 is installed in a printer 10, printer controller 16 reads the address 24 of cartridge memory 32 for a printer ID prompt (block 102). If printer controller 16 reads a prompt 23, then controller 16 reads the address 26 of the cartridge memory 32 for a printer ID (block 104). If printer controller 16 does not read a prompt 23 at block 102, then authorization process 100 ends. If printer controller 16 reads a printer ID 27 at block 104, then printer controller 16 compares the printer ID 27 from cartridge memory 32 to a printer ID for printer 10 to determine whether or not printer 10 is permitted to use cartridge 12 (block 106).

The printer ID for printer 10 may be stored at controller 16 or at a remote address accessible to controller 16. The printer ID for printer 10 may identify a single printer permitted to use cartridge 12 or a group of printers permitted to use cartridge 12. If the IDs match, then printer controller 16 determines that printer 10 can use cartridge (block 108). If the IDs do not match, then printer controller 16 determines that printer 10 cannot use cartridge 12 (block 110). Also, if the IDs do not match, the printer may display a message to the user indicating the cartridge is not authorized for use with this printer.

If printer controller 16 does not read a printer ID 27 at block 104, then printer controller 16 writes a printer ID 27 for printer 10 to cartridge memory 32 (block 112) and determines that printer 10 can use cartridge 12.

Figure 6:
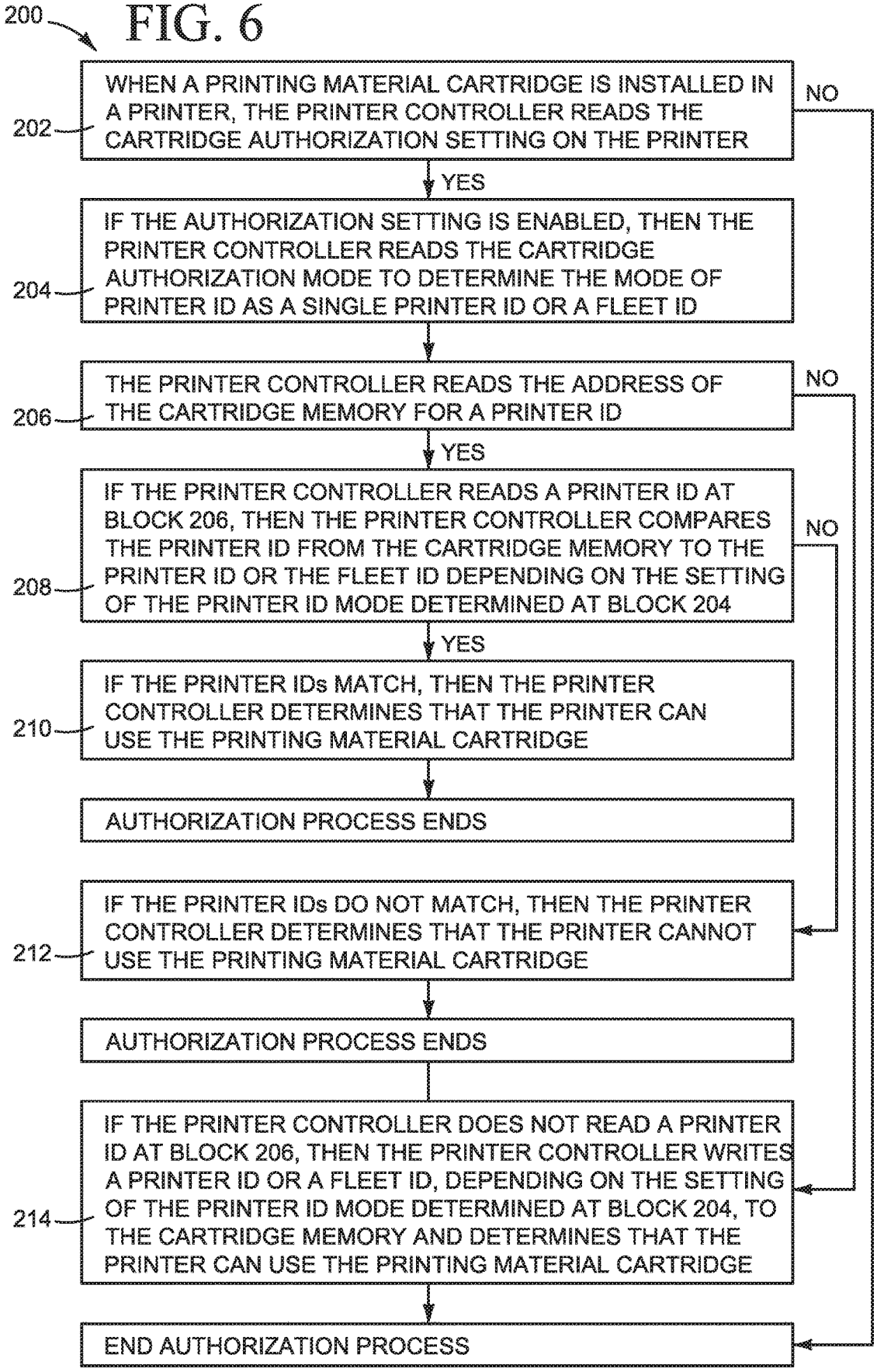
FIG. 6 illustrates another example of an authorization process for a printing material cartridge, such as might be implemented in the printer shown in FIG. 1.
Figure 7:
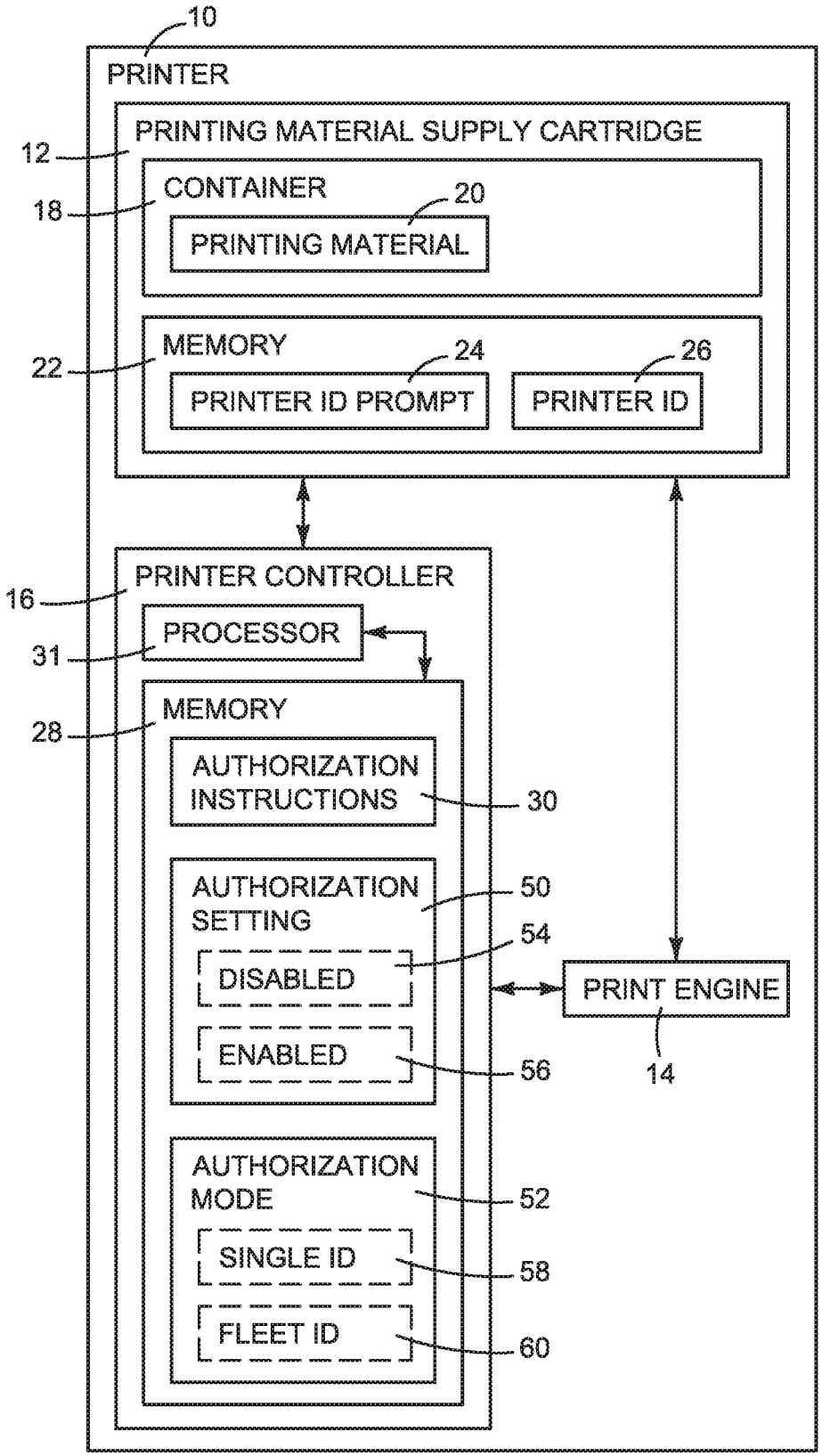
FIG. 7 illustrates one example of a printer controller with programming instructions to execute an authorization process, such as the processes shown in FIGS. 5 and 6.

FIG. 6 illustrates another example of an authorization process 200 in which the printer includes settings to enable cartridge authorization. FIG. 7 illustrates a printer controller 16 with an authorization setting 50, an authorization mode 52, and instructions 30 to execute authorization process 200 in FIG. 6.

Referring to FIGS. 6 and 7, when a printing material cartridge 12 is installed in printer 10, printer controller 16 reads cartridge authorization setting 50 (block 202 in FIG. 6). If authorization setting 50 is not enabled 54, then authorization process 200 ends. If authorization setting 50 is enabled 56, then printer controller 16 reads (1) cartridge authorization mode 52 to determine the mode of printer ID as a single printer ID 58 or a fleet ID 60 (block 204 in FIG. 6) and (2) the address 26 of cartridge memory 32 for a printer ID (block 206 in FIG. 6).

If printer controller 16 reads a printer ID 27 at block 206, then printer controller 16 compares the printer ID 27 from cartridge memory 32 to printer ID 58 or fleet ID 60 (depending on the setting of mode 52) to determine whether or not printer 10 is permitted to use cartridge 12 (block 208 in FIG. 6). If the IDs match, then printer controller 16 determines that printer 10 can use cartridge (block 210 in FIG. 6) and authorization process 200 ends. If the IDs do not match, then printer controller 16 determines that printer 10 cannot use cartridge 12 (block 212 in FIG. 6) and authorization process 200 ends. If printer controller 16 does not read a printer ID 27 at block 206, then printer controller 16 writes a single printer ID or a fleet ID for printer 10 to cartridge memory 32 (depending on the setting of mode 52) and determines that printer 10 can use cartridge 12 (block 214 in FIG. 6).

Figure 8A:
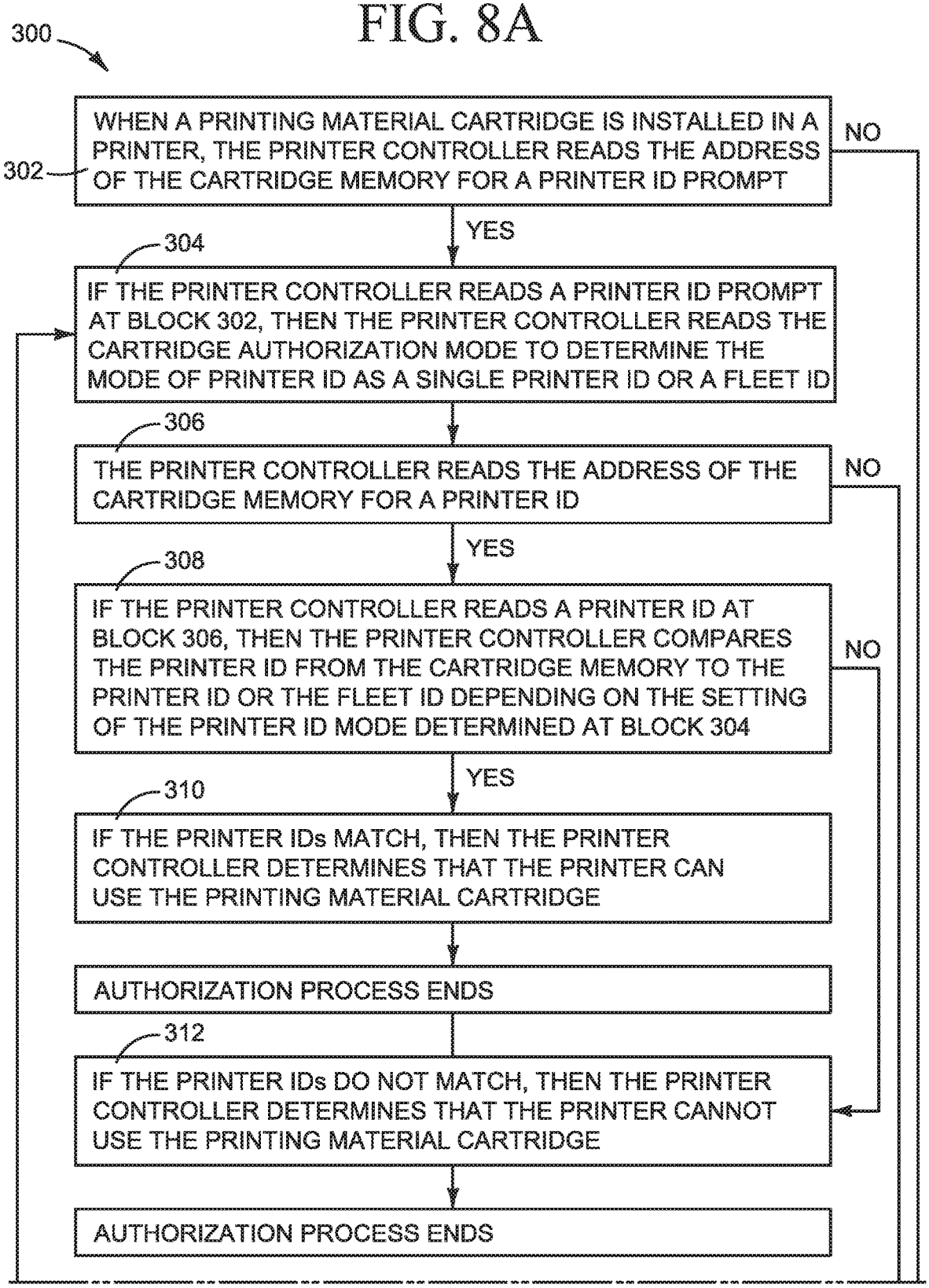
FIGS. 8A and 8B illustrate another example of a cartridge authorization process that combines elements of the processes shown in FIGS. 5 and 6.
Figure 8B:
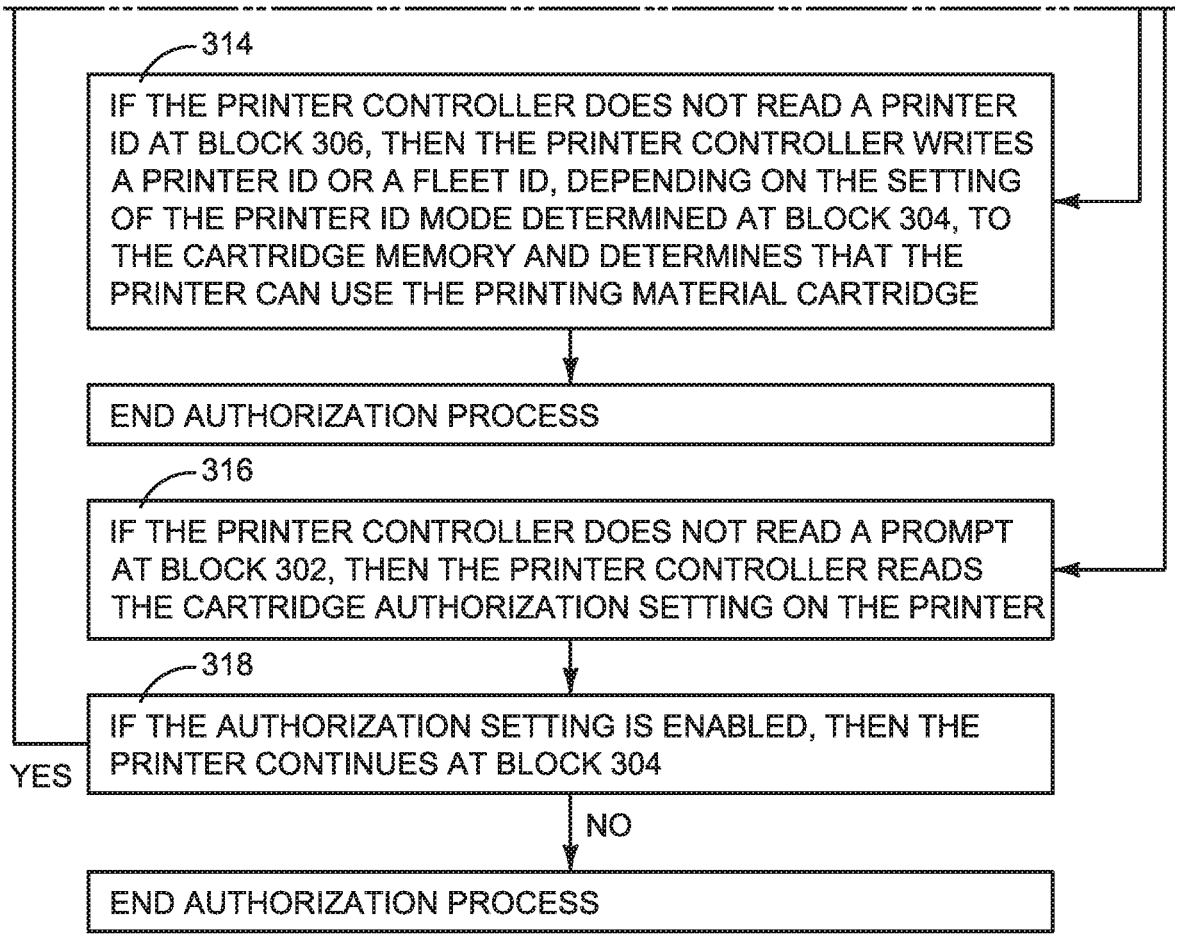

FIGS. 8A and 8B are a flow diagram illustrating another example of a cartridge authorization process 300 that combines elements of processes 100 and 200 in FIGS. 5 and 6. Referring to FIGS. 8A and 8B, when a printing material cartridge 12 is installed in a printer 10, printer controller 16 reads the address 24 of cartridge memory 32 for a printer ID prompt (block 302). If printer controller 16 reads a prompt 23, then printer controller 16 reads (1) cartridge authorization mode 52 to determine the mode of printer ID as a single printer ID 58 or a fleet ID 60 (block 304) and (2) the address 26 of the cartridge memory 32 for a printer ID (block 306). If printer controller 16 does not read a prompt 23 at block 302, then the authorization process proceeds to block 316 to determine whether or not authorization setting 50 is enabled on printer controller 16.

If printer controller 16 reads a printer ID 27 at block 306, then controller 16 compares the printer ID 27 from cartridge memory 32 to printer ID 58 or fleet ID 60 (depending on the setting of mode 52) to determine whether or not printer 10 is permitted to use cartridge 12 (block 308). If the IDs match, then printer controller 16 determines that printer 10 can use cartridge (block 310) and authorization process 300 ends. If the IDs do not match, then printer controller 16 determines that printer 10 cannot use cartridge 12 (block 312) and authorization process 300 ends.

If printer controller 16 does not read a printer ID 27 at block 304, then printer controller 16 writes a single printer ID or a fleet ID for printer 10 to cartridge memory 32 (depending on the setting of mode 52) and determines that printer 10 can use cartridge 12 (block 314) and the authorization process ends.

If printer controller 16 does not read a prompt 23 at block 302, then the authorization process proceeds to block 316 to determine whether or not authorization setting 50 is enabled on printer controller 16. At block 316, printer controller 16 reads cartridge authorization setting 50. If authorization setting 50 is not enabled 54, then authorization process 300 ends. If authorization setting 50 is enabled 56, then printer controller 16 continues executing process 300 at block 304 as described above (block 318).

Figure 9:
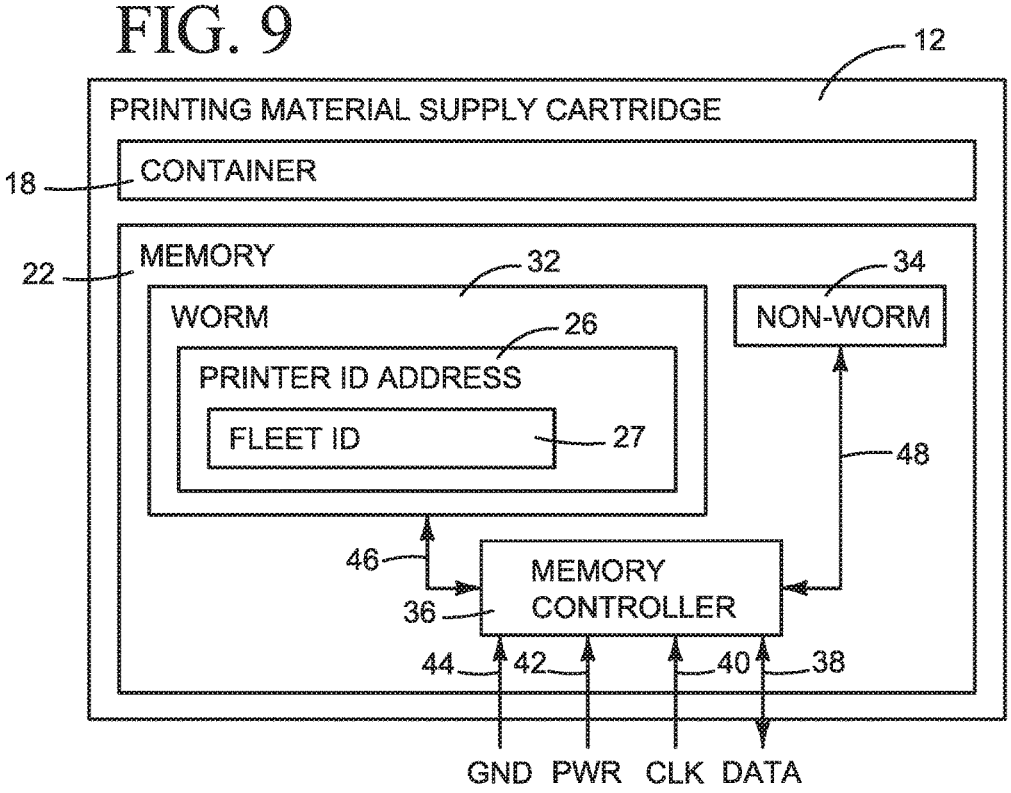
FIGS. 9 and 10 illustrate other examples of a printing material cartridge.

FIG. 9 illustrates a printing material cartridge 12 with no ID prompt and with a fleet ID value 27 written to printer ID memory address 26, for example at block 214 in FIG. 6. Although it is expected that a fleet ID 27 usually will be implemented as a single identifier identifying a corresponding fleet of printers, fleet ID 27 may also be implemented as multiple single identifiers each identifying a corresponding fleet of printers.

Figure 10:
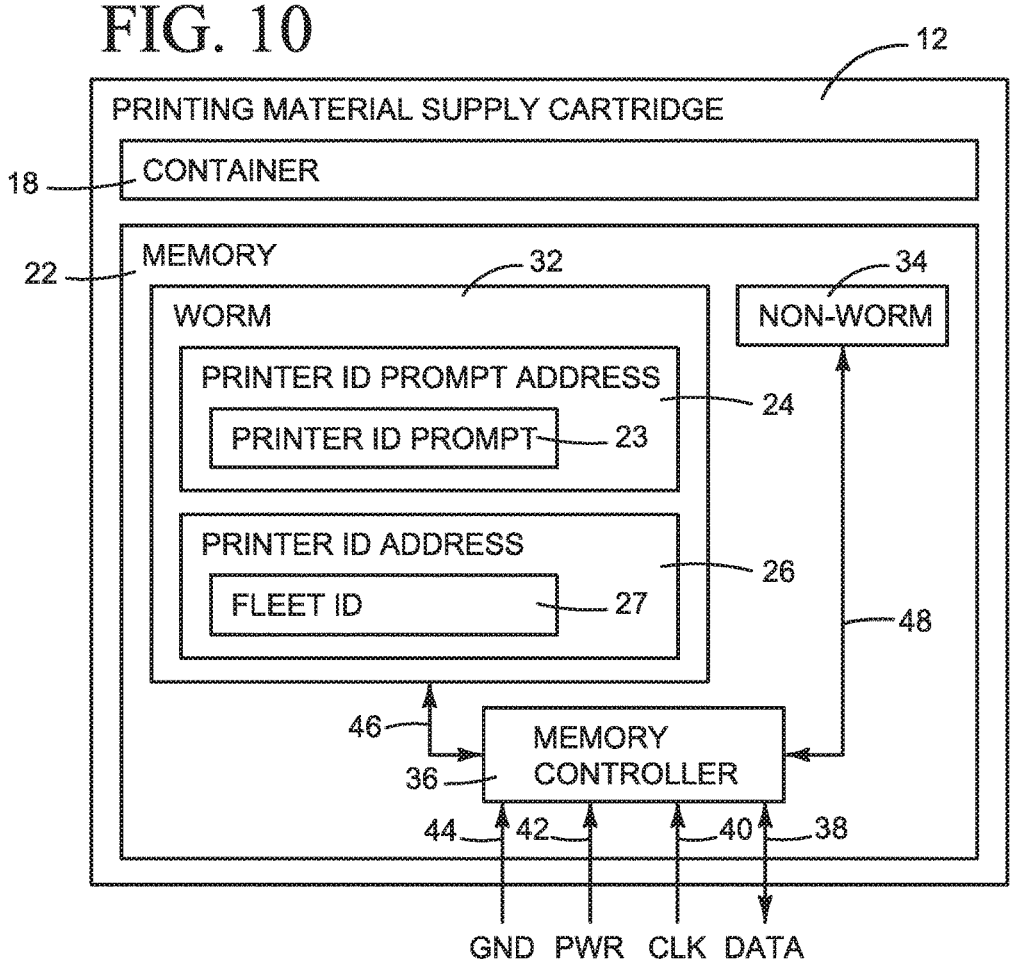

FIG. 10 illustrates a printing material cartridge 12 with an ID prompt 23 and with a fleet ID value 27 written to printer ID memory address 26, for example at block 112 in FIG. 5 or block 314 in FIG. 8B.

As noted at the beginning of this Description, the examples shown in the figures and described above illustrate but do not limit the scope of the patent. Other examples are possible. Therefore, the foregoing description should not be construed to limit the scope of the patent, which is defined in the following Claims.

"A" and "an" as used in the Claims means one or more.

The invention claimed is:

1. A printing material cartridge installable in a printer having a printer controller, the printing material cartridge comprising:

a container to contain a printing material; and a memory to enable an exchange of information between the printing material cartridge and the printer controller when the printing material cartridge is installed in the printer, the memory including:

a first write once then read only memory (WORM) with a first memory address, a second WORM with a second memory address, and a memory controller to control reading and writing to and from the first WORM, to control reading and writing to and from the second WORM, in response to reading or writing by the printer controller, wherein, the first memory address is to store a printer identifier (ID), the second memory address is to store prompt information to prompt the printer controller to perform an authorization process, the memory controller to control a reading of the second memory address to read the prompt information for the authorization process, in response to a first read of the printer controller, the memory controller to control a reading of the first memory address, in response to a second read of the printer controller according to the read prompt information at the second memory address, the memory controller to control a writing, to the first memory address of the first WORM, of a single printer ID or a fleet of printers ID provided from the printer controller resulting from the second read of the printer controller not reading the printer ID at the first memory address and a determination by the printer controller of an authorization mode of the printer ID corresponding to the single printer ID or the fleet of printers ID, to store the provided single printer ID or the fleet of printers ID at the first memory address of the first WORM.

2. The printing material cartridge of claim 1, wherein the prompt information at the first memory address includes a single bit value that when read by the printer controller by the first read prompts the printer controller to perform the second read at the first memory address, which in response to the not reading of the printer ID at the first memory address causes the printer controller to control the determination of the authorization mode of the printer ID corresponding to the single printer ID or the fleet of printers ID and to write the single printer ID or the fleet of printers ID to the first memory address of the first WORM.

3. The printing material cartridge of claim 1, comprising printing material in the container.

4. The printing material cartridge of claim 3, wherein the printing material is toner or ink.

5. The printing material cartridge of claim 1, wherein the memory is embodied in an integrated circuit chip affixed to the container and operatively connectable to the printer controller via contact pads and conductive traces.

6. The printing material cartridge of claim 1, wherein the memory controller is to exchange information with the printer controller through data and clock terminals, and with the first WORM and the second WORM through internal busses.

7. The printing material cartridge of claim 1, wherein the second memory address is a single bit memory location that is in a written state (a logic 1) to, in response to the first read, prompt the printer controller in response to the second read at the first memory address to control the determination of the authorization mode of the printer ID corresponding to the single printer ID or the fleet of printers ID and to write the single printer ID or the fleet of printers ID to the first memory address of the first WORM.

8. The printing material cartridge of claim 1, wherein the first memory address has an identifier value in a written state, or a no identifier value in an unwritten state to cause the not reading of the printer ID.

9. The printing material cartridge of claim 8, wherein the first memory address is a 16 bit memory location in an unwritten state (0x0000) for no identifier or in a written state with a value representing a the single printer ID or the fleet of printers ID.

10. The printing material cartridge of claim 8, wherein the first memory address is in the written state and the value representing the single printer ID or the fleet of printers ID is a hashed, encrypted, or another derived version of an actual identifier parameter.

11. The printing material cartridge of claim 10, wherein the fleet of printers ID identifies a group of printers owned or operated by a single entity or identified as being subject to an obligation to limit printing to the group.

12. A printer comprising:

a printer controller; and the printing material cartridge of claim 1.

13. The printing material cartridge of claim 1, wherein the printing material is toner or ink.

14. The printing material cartridge of claim 1, wherein the information at the second memory address includes a single bit value in a written state, that when read by the printer controller by the first read, prompts the printer controller to read the first memory address by the second read, and the first memory address is a memory location which in an unwritten state causes the not reading of the printer ID by the second read by the printer controller, and causes the printer controller to write the single printer ID or the fleet of printers ID at the first memory address of the first WORM.

15. A printing material cartridge installable in a printer having a printer controller, the printing material cartridge comprising:

a container to contain a printing material; and a memory to enable an exchange of information between the printing material cartridge and the printer controller when the printing material cartridge is installed in the printer, the memory including:

a first write once then read only memory (WORM) with a first memory address, a second WORM with a second memory address, and a memory controller to control reading and writing to and from the first WORM, to control reading and writing to and from the second WORM, in response to reading and writing by the printer controller, wherein the second memory address is a 16 bit memory location that is either in an unwritten state or a written state with a value representing an printer ID, the second memory address is a single bit memory location in a written state to store a printer identifier (ID), the second memory address is to store prompt information to prompt the printer controller to perform an authorization process, the memory is embodied in an integrated circuit chip affixed to the container and operatively connectable to the printer controller via contact pads and conductive traces, the memory controller is to exchange information with the printer controller through data and clock terminals and with the first WORM and the second WORM through internal buses, the memory controller to control a reading of the second memory address to read the prompt information for the authorization process, in response to a first read of the printer controller, the memory controller to control a reading of the first memory address, in response to a second read of the printer controller according to the read prompt information at the second memory address, and the memory controller to control a writing, to the first memory address of the first WORM, of a single printer ID or a fleet of printers ID provided from the printer controller resulting from the second read of the printer controller not reading the printer ID at the first memory address and a determination by the printer controller of an authorization mode of the printer ID corresponding to the single printer ID or the fleet of printers ID, to store the provided single printer ID or the fleet of printers ID at the first memory address of the first WORM.

16. The printing material cartridge of claim 15, wherein the single printer ID or the fleet of printers ID is a hashed, encrypted, or another derived version of an actual identifier parameter.

17. The printing material cartridge of claim 15, wherein the memory is a four terminal memory or a two terminal memory.

* * * * *